United States Patent [19]

Ginat

[11] 4,236,615

[45] Dec. 2, 1980

[54] PACKING CASE HAVING EXPANSIBLE COMPARTMENTS

[76] Inventor: Esther Ginat, 20 Bruria St., Tel Aviv, Israel

[21] Appl. No.: 973,810

[22] Filed: Dec. 28, 1978

Related U.S. Application Data

[63] Continuation of Ser. No. 831,991, Sep. 9, 1977, abandoned.

[30] Foreign Application Priority Data

Aug. 2, 1977 [IL] Israel ..... 52723

[51] Int. Cl.[3] ..... A45F 3/00

[52] U.S. Cl. ..... 190/52; 190/44; 224/202

[58] Field of Search ..... 190/51, 52, 44; 150/1.7, 30; 224/191, 202, 209

[56] References Cited

U.S. PATENT DOCUMENTS

| | | | |
|---|---|---|---|
| 1,841,154 | 1/1932 | Rath | 190/52 |
| 2,025,101 | 12/1935 | Halpin | 190/52 X |
| 2,078,624 | 4/1937 | Wolff | 190/44 X |
| 2,164,493 | 7/1939 | Branen | 190/52 |
| 2,597,194 | 5/1952 | Sholl | 190/52 |
| 3,870,132 | 3/1975 | Hanley | 150/30 X |

*Primary Examiner*—Donald F. Norton
*Attorney, Agent, or Firm*—Benjamin J. Barish

[57] ABSTRACT

Packing cases having expansible compartments are described in which the outer wall enclosure of the case is formed with an opening lined with a fastener device, such as a zipper, and an expansible partition of flexible material is secured along its peripheral edges to the edges of the opening, the partition being normally disposed within the main compartment of the case to form an auxiliary compartment separate from but expansible within the main case compartment and closable by the fastener device. In one described embodiment, the opening is formed in an end wall of the case, and the partition is dimensioned such that the expansible auxiliary compartment defined by it is expansible to approximately the full volume of the main compartment. Two further embodiments are described in which the bottom wall of the case may be opened, and the partition, in addition to being disposable within the main compartment to form an expansible auxiliary compartment therein, may also be projected through the opened bottom wall to form a bottom extension of the main compartment.

6 Claims, 12 Drawing Figures

PACKING CASE HAVING EXPANSIBLE COMPARTMENTS

This application is a continuation of application Ser. No. 831,991, filed Sept. 9, 1977 and now abandoned.

BACKGROUND OF THE INVENTION

The present invention relates to packing cases, such as knapsacks, suitcases, travelling bags, and the like, particularly to packing cases constructed so as to provide expansible compartments.

There are many applications wherein it is desirable to provide expansible compartments within packing cases. One such application would be to permit the introduction of dirty clothing or the like into a compartment which keeps it separate from the remaining contents of the case and which is expansible to accommodate varying quantities of dirty clothing. Another such application would be to permit the main compartment of the case to be expanded to accommodate larger quantities of articles.

SUMMARY OF THE INVENTION

According to a broad aspect of the present invention, there is provided a packing case having an outer wall enclosure defining a main internal compartment, the outer wall enclosure being formed with an opening lined with a fastener device for closing same, and an expansible partition of flexible material secured along its peripheral edge to the outer wall enclosure and normally disposed within the main compartment so as to form an auxiliary compartment separate from but expansible within the main compartment and closable by the fastener device.

In one described embodiment, the outer wall enclosure of the case includes a top wall, a bottom wall, two side walls, and two end walls, the opening being formed in and within the perimeter of one of the end walls. The partition is attached to the latter end wall and is dimensioned such that the expansible auxiliary compartment defined thereby is expansible within the main compartment to substantially the full volume of the main compartment.

A second embodiment of the invention is described wherein the fastener device lines the junctures of the bottom wall with two end walls and one side wall, leaving the bottom wall permanently connected to the second side wall. The expansible partition includes four peripheral edges joined to the two side walls and the two end walls, respectively, whereby the expansible partition may not only be disposed within the main internal compartment to form an expansible compartment therein, but may also be projected out of the opened bottom wall to form a bottom extension of the main compartment.

A third described embodiment of the invention is similar to the above second embodiment, except that the expansible partition includes six peripheral edges, three of which are joined to the two end walls and the one side wall, and the other three of which are joined to the fastener lined edges of the bottom wall. Such an arrangement, as in the previously described one, also permits the expansible partition not only to be disposed within the main internal compartment of the case to form an expansible compartment therein, but also to be projected out of the opened bottom wall to form a bottom extension of the main compartment.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF THE PREFERRED EMBODIMENTS

Figure 1F:
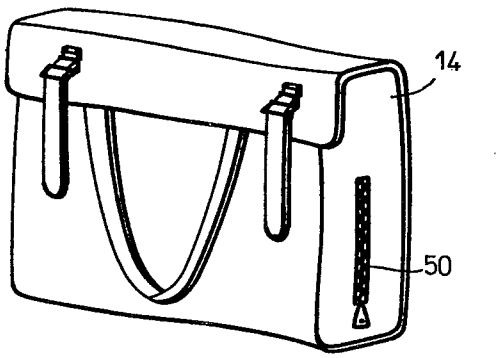
FIGS. 1*e* and 1*f* illustrate two modifications in the case of FIGS. 1*a*–1*d;*

The embodiment of the invention illustrated in FIGS. 1*a*–1*d* is in the form of a knapsack particularly for carrying clothing or other supplies on a trip or march. The case, generally designated 2, is made of plastic, canvas or leather, for example, and includes a top wall 4, a bottom wall 6, two side walls 8, 10, and two end walls, 12, 14. These walls form an outer wall enclosure defining an internal main compartment 15. Straps 16 are provided for securing the top wall 4, and a shoulder harness 18 is provided to facilitate carrying the knapsack on the user's back.

Figure 1E:
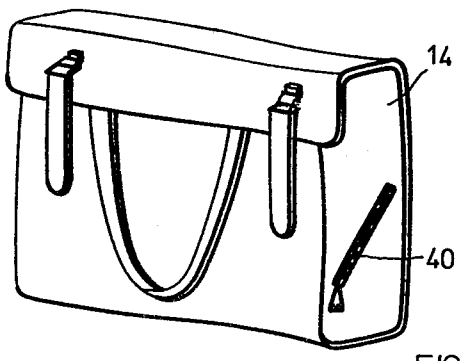
Figure 1B:
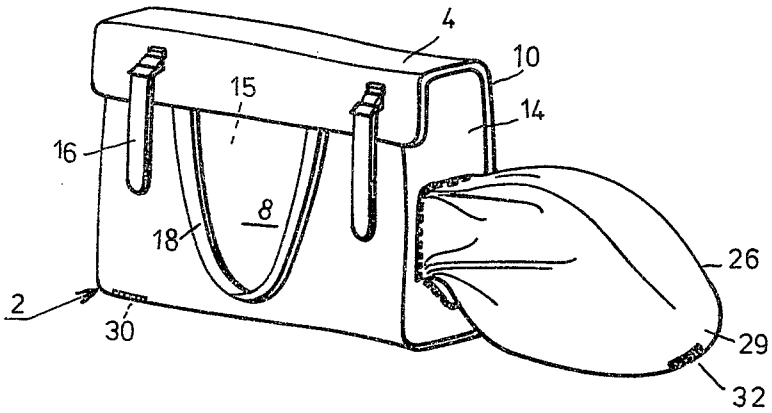
FIGS. 1*a*–1*d* illustrate one form of case, in various conditions thereof, constructed in accordance with the invention.
Figure 1A:
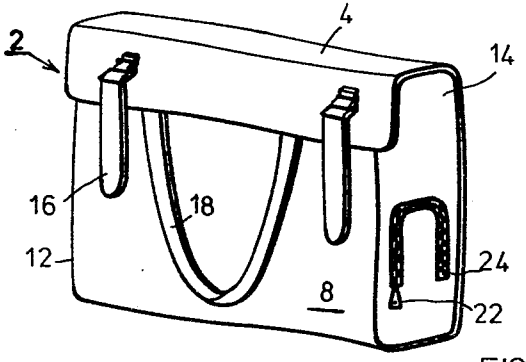
Figure 1D:
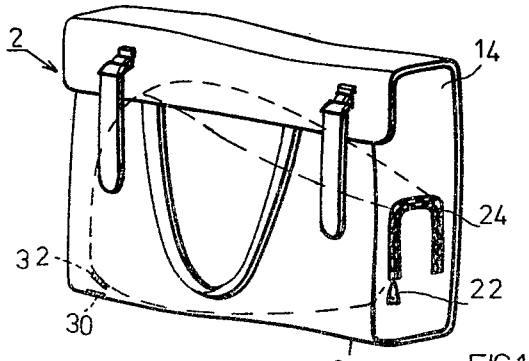

End wall 14 is formed with an opening 20, the opening in the embodiment of FIGS. 1*a*–1*d* being of U-shaped configuration (FIGS. 1*a*, 1*d*). Opening 20 is closed by a zipper fastener device including a sliding zipper tab 22 and zipper teeth 24 lining the edges of opening 20. An expansible partition 26 of flexible material, such as cloth, is normally disposed with the main compartment 15 defined by the outer walls of the case. Expansible partition 26 defines an auxiliary compartment 28 which has a closed end 29 and an open end whose peripheral edges are secured to the peripheral edges of opening 20 in the case end wall lined with the zipper teeth 24.

Figure 1C:
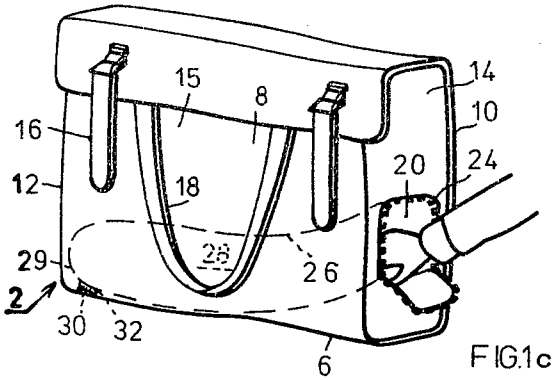

Auxiliary compartment 28 is separate from but expansible within the main compartment, and is also closable by the zipper fastener device 22, 24. Partition 26 is dimensioned such that the auxiliary compartment 28 defined thereby is expansible within the main compartment 15 to approximately the full volume of the main compartment, as shown in broken lines in FIG. 1*d*. In addition, the inner face of the bottom wall 6, adjacent to end wall 12 (i.e. opposite to the opened end wall 14) includes a strip 30 of interlocking fibrous material, such as "Velcro" TM; and a mating interlocking fibrous strip 32 is applied to the corresponding end of the expansible partition 26. This retains the partition in place within the main compartment 15, particularly when the auxiliary compartment is only partly filled as shown in FIG. 1*c*.

The normal manner of using the knapsack illustrated in FIGS. 1*a*–1*d* will be apparent from the above description. Thus, if the auxiliary compartment 28 defined by the expansible partition 26 is empty, the main compartment 15 of the knapsack may be filled to its maximum capacity with clothing or other supplies. In the course of time, it will be desirable to separate some of the contents of the knapsack, for example dirty clothing or dirty utensils, from others of its contents. For this purpose, zipper tab 22 may be operated to open opening 20 in end wall 14, thereby providing access to the interior of the auxiliary compartment 28. The dirty clothing or utensils may then be inserted into compartment 28, wherein they will be kept separate from the contents of the main compartment 15. As shown particularly in FIG. 1*d*, the auxiliary compartment 28 is expansible to substantially the full volume of the main compartment 15 (and at its expense) to as to accommodate larger quantities of dirty clothing or utensils.

FIGS. 1*e* and 1*f* illustrate slight variations in the case construction, wherein the zipper-lined opening in the end wall (14) is of linear configuration rather than of the U-shaped configuration of opening 20 in FIGS. 1*a*–1*d*. Thus, in FIG. 1*e*, this opening, shown as 40, follows an inclined line, and in FIG. 1*f*, the opening 50 follows a vertical line. Forming the opening according to a linear configuration facilitates its opening and closing particularly when zippers are used for the fastening devices.

FIGS. 2*a*–2*c* and 3*a*–3*c*, respectively, illustrate two further embodiments of the invention, wherein the partition is constructed such that it may not only be disposed within the main internal compartment for forming an expansible auxiliary compartment therein, but may also be projected out of an openable bottom wall of the case to form a bottom extension of the main compartment.

Figure 2C:
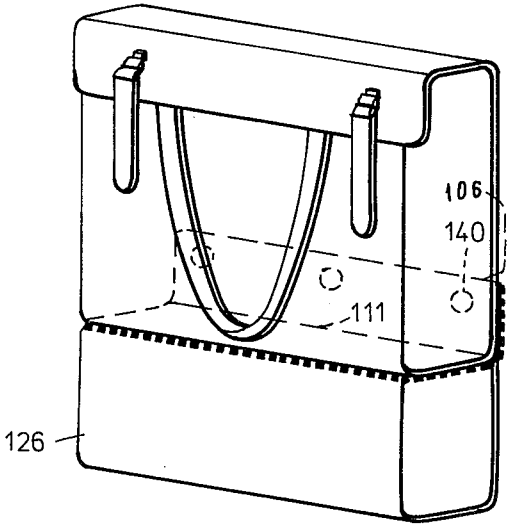
FIGS. 2*a*–2*c* illustrate various conditions of a second form of case constructed in accordance with the invention.
Figure 2B:
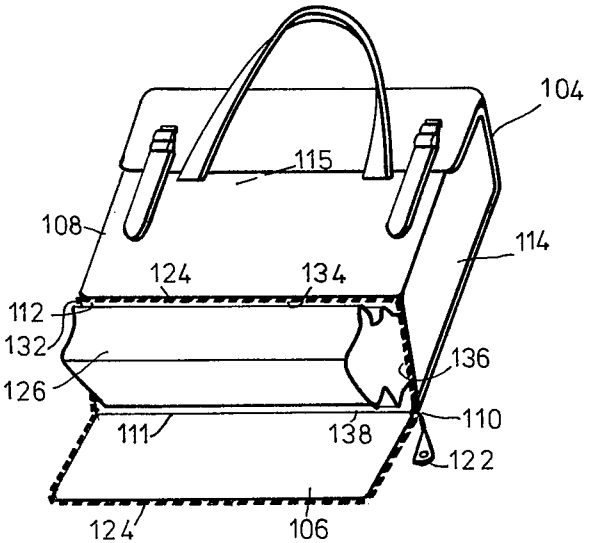
Figure 2A:
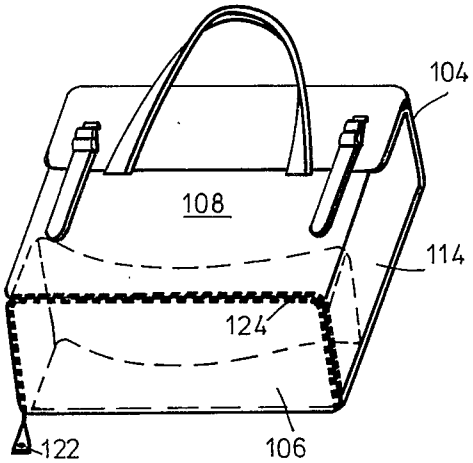

Thus, the embodiment of the invention illustrated in FIGS. 2*a*–2*c* includes a top wall 104, a bottom wall 106, two side walls 108, 110, and two end walls 112, 114. In this case, however, the fastener device, namely zipper teeth 124 closable by the zipper tab 122, lines the junctures of bottom wall 106 with end wall 112, side wall 108, and the end wall 114, leaving the bottom wall permanently connected to the second side wall 110 along juncture line 111. The expansible partition 126 includes four peripheral edges joined to the lower ends of the two side walls and the two end walls, namely edge 132 joined to end wall 112, edge 134 joined to side wall 108, edge 136 joined to end wall 114, and edge 138 joined to side wall 110.

It will be seen that the expansible partition 126 may be used in two different manners in the case of FIGS. 2*a*–2*c*. Thus, it could be used in the same manner as in the case of FIGS. 1*a*–1*d*, namely as an expansible auxiliary compartment disposable within the main compartment 115 of the case. For such use, it is only necessary to zip-open the zipper along one end wall, namely wall 112, and then to introduce the articles through that opening into the space between bottom wall 106 and partition 126, whereupon the latter partition will define with the bottom wall an auxiliary compartment expansible within the main compartment 115.

The expansible partition 126 may also be used to provide a bottom extension to the main compartment 115. This is more particularly illustrated in FIG. 2*c*, wherein the bottom wall 106 is folded upwardly, along its juncture line 111 with side wall 110, and is fastened to the outer face of that side wall by means of fasteners, for example buttons 140 carried by the outer face of the side wall and receivable within holes formed along the corresponding edge of the bottom wall 106.

Figure 3C:
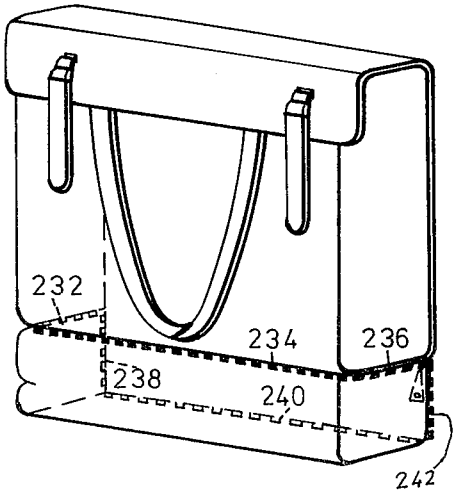
FIGS. 3*a*–3*c* illustrate various conditions of a third form of case constructed in accordance with the invention.
Figure 3B:
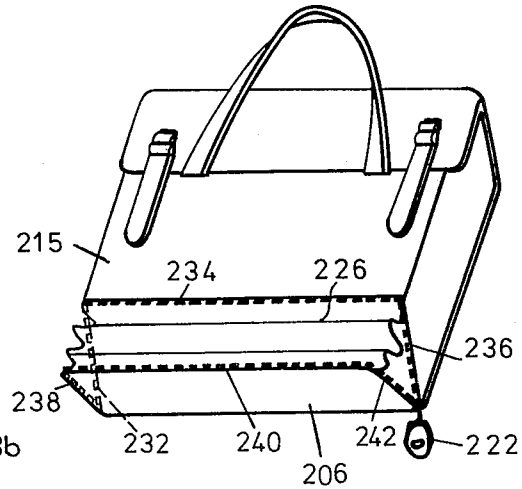
Figure 3A:
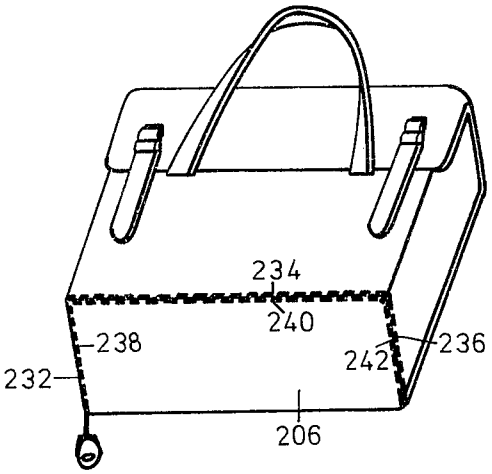

FIGS. 3*a*–3*c* illustrate a modification in the construction of the case of FIGS. 2*a*–2*c*, wherein the expansible partition 226 is formed with six peripheral edges, three of which (edges 232, 234, 236) are joined to the edges of the two end walls and one side wall as in FIGS. 2*a*–2*c*, and the remaining three of which (edges 238, 240, 242) are joined to the three zipper-lined edges of the bottom wall 206.

Such a construction may also be used for the two purposes as the case of FIGS. 2*a*–2*c*. Thus, the zipper tab 222 may be moved to open one or two sides, permitting articles, such as dirty clothing, to be stuffed between the bottom wall 206 and the expansible partition 226, the latter forming a separate expansible auxiliary compartment with the bottom wall 206 as in FIGS. 2*a*–2*c*. In addition, zipper tab 222 may be moved to open all three sides containing the zipper teeth. In such case, the bottom wall 206 may be opened to assume a vertical position, forming a vertical extension of the rear side wall, whereby the expansible partition 226 will be projected downwardly out of the open bottom and will form a bottom extension to the main compartment 215.

While the invention has been described with respect to three preferred embodiments all in the form of a knapsack, it will be appreciated that the invention could also be advantageously used in other types of packing cases, such as suitcases, travelling bags and the like, and that many other variations, modifications and applications of the invention may be made.

What is claimed is:

1. A packing case having an outer wall enclosure defining a main internal compartment therein; said outer wall enclosure being formed with an opening lined with a fastener device for closing same; and an expansible partition of flexible material secured along its peripheral edges to the outer wall enclosure and normally disposed within said main compartment so as to form an auxiliary compartment separate from but expansible within said main compartment and closable by said fastener device, said outer wall enclosure including a top wall, a bottom wall, two side walls, and two end walls, said opening being formed in and within the perimeter of one of said end walls, said partition being dimensioned such that the expansible auxiliary compartment defined thereby is expansible within the main compartment to substantially the full volume of the main compartment.

2. A case according to claim 1, wherein the inner face of the end of the case bottom wall remote from said one end wall, and the corresponding face of the expansible partition, include interlocking fibrous strips for interlocking the expansible auxiliary compartment to the bottom wall.

3. A case according to claim 1, wherein the edges of said opening in the case end wall are of a U-shaped configuration.

4. A case according to claim 1, wherein the edges of said opening in said case and wall are of a linear configuration.

5. A case according to claim 1, wherein said fastener device comprises a sliding zipper tab, and zipper teeth lining the edges of said opening.

6. A case according to claim 1, wherein said expansible partition is secured along its peripheral edges to the edges of said opening in the outer wall enclosure.

* * * * *